United States Patent [19]

Litt et al.

[11] Patent Number: 4,586,318

[45] Date of Patent: May 6, 1986

[54] BAG FORMING AND BAGGER APPARATUS AND METHOD

[75] Inventors: Irving L. Litt, Rockvill Centre; Jose Torres, Ridgewood, both of N.Y.

[73] Assignee: All Packaging Machinery & Supplies Corp., Ronkonkoma, N.Y.

[21] Appl. No.: 564,253

[22] Filed: Dec. 22, 1983

[51] Int. Cl.[4] ..... B65B 7/06; B65B 9/13; B65B 43/36

[52] U.S. Cl. ..... 53/459; 53/372; 53/393; 53/468; 53/469; 53/567; 53/570

[58] Field of Search ..... 53/128, 131, 372, 384, 53/385, 410, 411, 451, 459, 467, 468, 469, 570, 563, 567, 393; 156/251, 290, 515; 493/196, 197, 198, 200, 203

[56] References Cited

U.S. PATENT DOCUMENTS

| | | | |
|---|---|---|---|
| Re. 28,350 | 3/1975 | Lerner | 53/459 |
| 2,545,243 | 3/1951 | Rumsey | 156/251 X |
| 3,293,824 | 12/1966 | Dorr | 53/131 |
| 3,448,555 | 6/1969 | Shabram | 53/459 |
| 3,481,102 | 12/1969 | Dolman | 53/459 |
| 3,594,978 | 7/1971 | Spitznagel | 53/385 X |
| 4,110,956 | 9/1978 | Weisberg | 53/384 X |
| 4,423,583 | 1/1984 | Carey | 53/384 X |

FOREIGN PATENT DOCUMENTS

| | | | |
|---|---|---|---|
| 2352528 | 5/1975 | Fed. Rep. of Germany | 493/196 |

*Primary Examiner*—Robert L. Spruill
*Assistant Examiner*—Michael D. Folkerts
*Attorney, Agent, or Firm*—Nolte, Nolte & Hunter

[57] ABSTRACT

Apparatus and method for continuously forming and filling plastic film by successively providing a continuous length of the film, slitting only the topside of the film at pre-determined intervals lengthwise of the film while tack sealing together both the top and bottom sides of the film at corresponding intervals, moving the slitted and tack sealed film into a bag forming and filling station, forming the plastic film successively into a plurality of open top bags, filling each bag with the desired material, thereafter simultaneously sealing the top of each filled bag and sealing the bottom of the next bag to be filled, removing each filled bag from the filling station and simultaneously advancing the next bag to be filled into the filling station.

16 Claims, 7 Drawing Figures

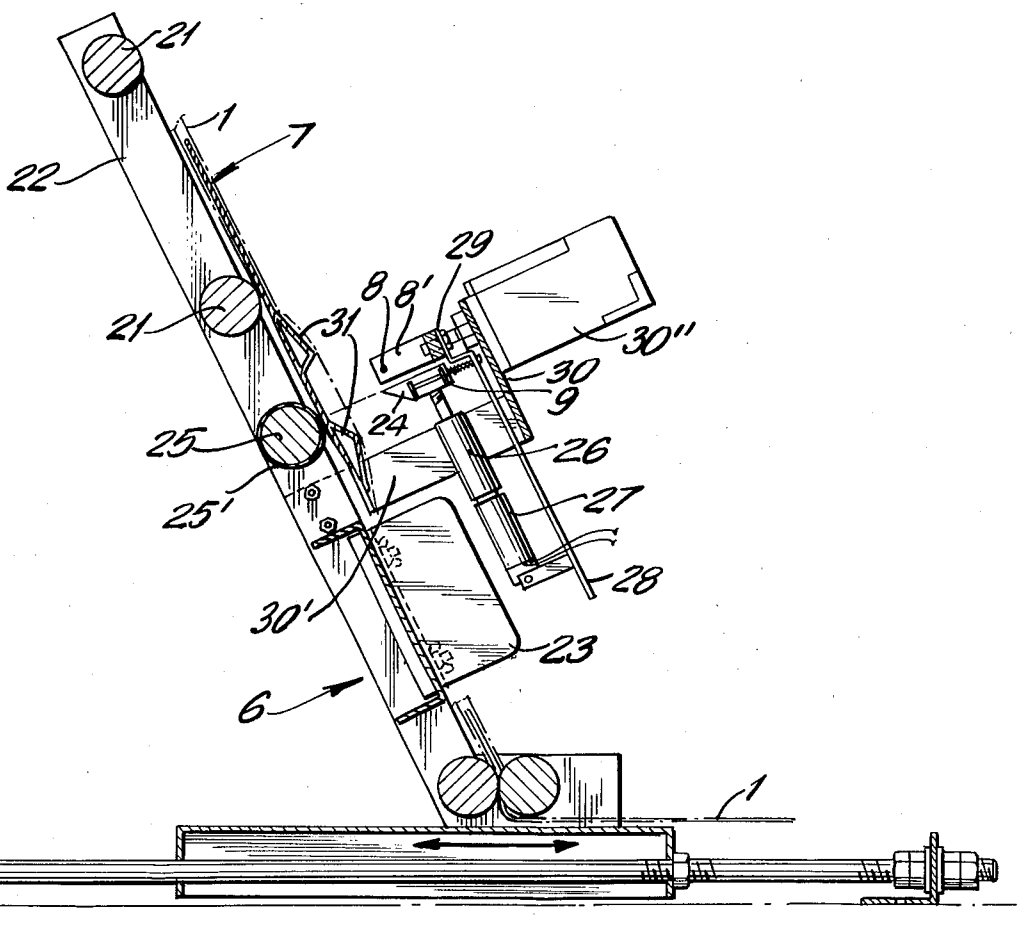
FIG. 4
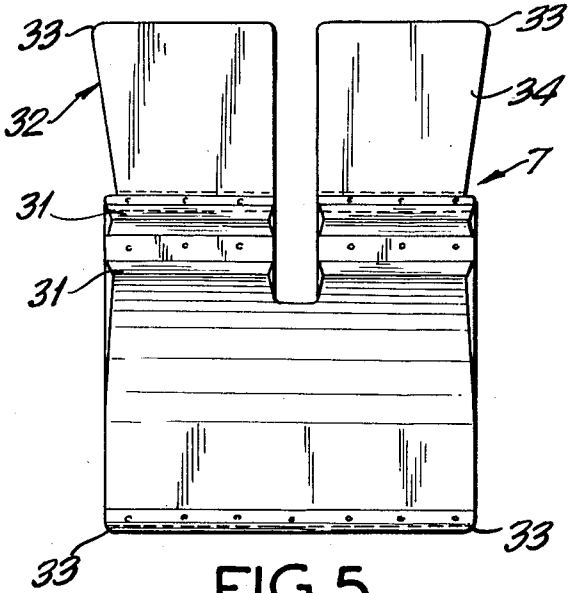
FIG. 5
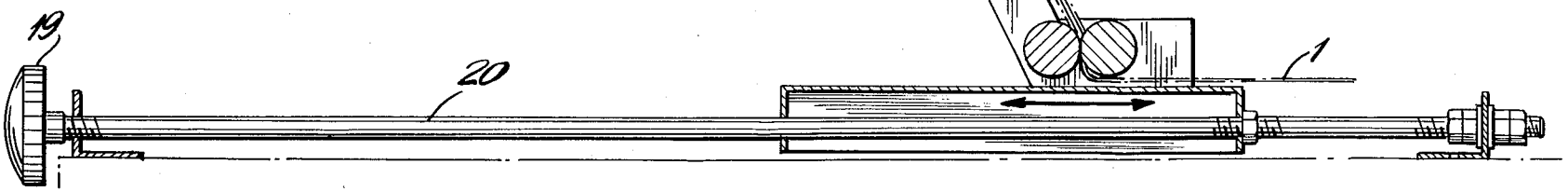

BAG FORMING AND BAGGER APPARATUS AND METHOD

FIELD OF THE INVENTION

The present invention relates to machinery for forming bags and for packaging and sealing articles or substances in the formed bags.

More specifically the invention concerns the packaging of articles or substances in a plurality of plastic bags by means of an assembly of apparatus for forming the bags from plastic stock tubing, and packaging the article or articles during the bag forming and sealing operations.

DESCRIPTION OF THE PRIOR ART

It is known to automatically package articles in a continuous assembly line operation, wherein the bags are formed from rolls of flat or tubular plastic material.

Such prior art operations, however, either require the formation of the bag around the article or articles to be packaged or complicated machinery in which the bag segments are cut, filled and sealed in several operations at the packaging stage.

SUMMARY OF THE INVENTION

The apparatus of the invention comprises means in a continuous bag forming and bagging assembly for separating the sides of the flat tubing, slitting only the top side of the tubing at predetermined intervals lengthwise thereof, tack sealing the slitted topside of the tubing to the unslit underside at the same predetermined interval, optionally simultaneously puncturing the tubing at said intervals, thus presenting a traveling web of tubing, comprising partially formed bag sections, to a packaging area where the slitted topside of the tubing is opened to receive a fill of the desired material at spaced intervals. The apparatus of the invention provides grippers for gripping the sides of the tubing and holding the same immobile in a fixed, flat position. Then, during the filling operation, the grippers move toward one another to assist in the opening of the tube, after which they retract to their first position in which the tube is fixed and flattened, prepared for lay flat sealing for forming the tubing into a series of bags. The invention then provides for simultaneously sealing the top of a filled bag and the bottom of a bag next to be filled, and finally for separating each filled bag from the next bag to be filled, and removing the scrap tubing resulting from the separation, as by a blow-off and scrap receiving station provided internally of the apparatus.

BRIEF DESCRIPTION OF THE DRAWINGS

As will be apparent, the invention consists in the construction, combination, and arrangement of parts all as hereinafter more fully described, claimed, and illustrated in the accompanying drawings, wherein:

FIG. 4 is a section taken along the lines 4—4 of FIG. 3;

FIG. 5 is a plan view of a slitter plate designed to facilitate the slitting and tack sealing of the continuous tubular film;

DETAILED DESCRIPTION OF THE INVENTION

Figure 1:
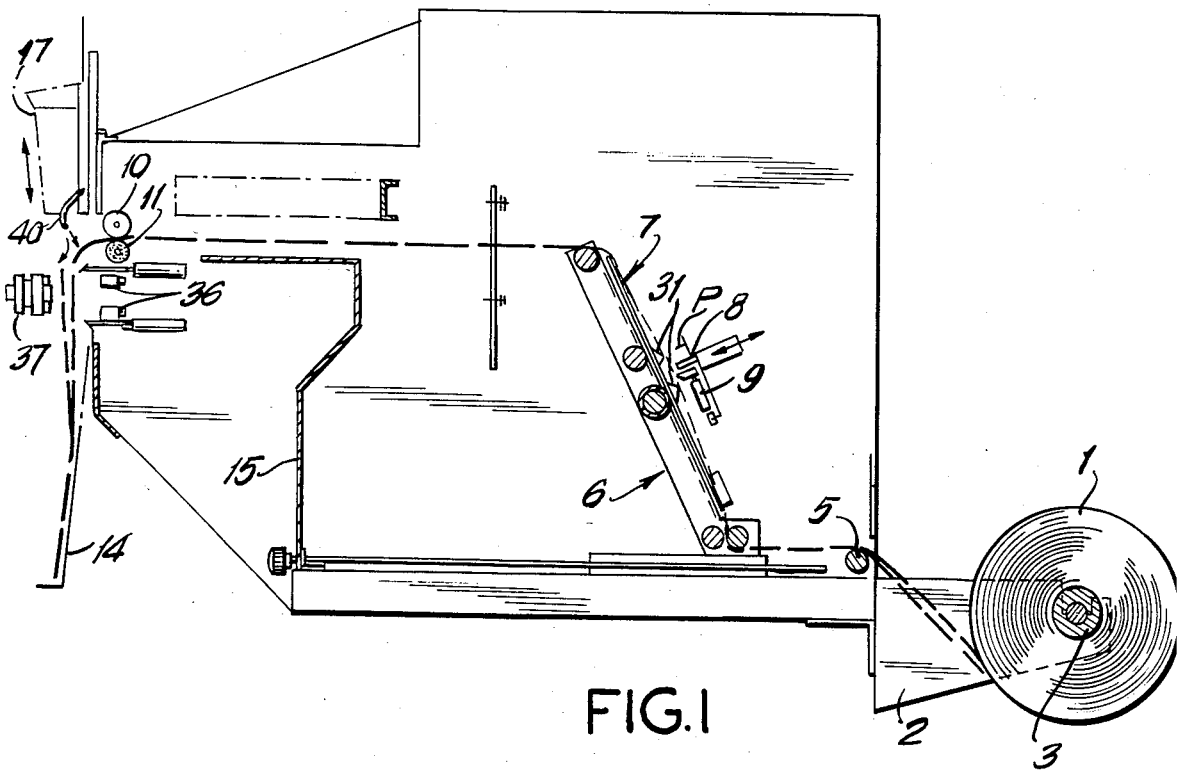
FIG. 1 is a schematic side view of the present inventive composite bag former-bag filler apparatus.

Referring now more particularly to FIG. 1 which exemplifies a preferred bag former/filler apparatus and method of making the same according to the present invention, there is shown a product roll 1 of thermoplastic film which may be composed, for example, of polyethylene, polypropylene, PVC, or the like, of preselected width, for example, eleven and one-fourth inches more or less, as may be desired having regard to the contents and nature of the material with which the bags are to be filled.

The film roll of thermoplastic tubing 1 is mounted for rotation on a support bracket 2 by means of a spindle or product roller with co-acting chucks 3. As the roll of tubing film 1 is unwound from the rotating roller 3 at the entrance end of the chassis, it rides over the rear idler roll 5 at the entrance end of the bag former/filler assembly. From that point the continuous length of tubular film 1 is passed between the nip of a pair of guide rollers fixed at the base of an obliquely disposed transport unit assembly 6 with guide rollers which are constructed and arranged to keep the moving film on course as it passes through the bag slitting and tacking assembly.

At the start of the operation a slitter plate 7 is manually pushed through the open leading edge of the tubular film 1 as it emerges from the nip of the two guide rollers at the base of the transport assembly 6. Midway of its passage over the transport unit 6 only the exposed topside surface of the film 1 is slit widthwise by means of heated slitter wire apparatus 8. At the same time, the topside surface may be centrally perforated above the slit to provide air exhaust at the packaging and sealing stage. At the same time, the top and under surfaces are tack sealed below the slit by means of heated tack sealer 9.

It should be understood that the step of puncturing the tubing medially, tack sealing the topside to the underside, and slitting only the topside all take place substantially simultaneously as indicated in FIG. 1 of the drawings. The tack seal is covered by a special electrical grade heavy duty Teflon to avoid sticking of the plastic material and to avoid overheating. The tack sealer contacts the Teflon covered wheel 25' disposed centrally of roller 25, the Teflon cover being locked in place via a locking device, not shown.

The purpose of the optional periodic puncture is to relieve the bag of its entrapped air at the packaging and sealing stage where a product does not substantially completely fill the bag. The puncture would be eliminated, for example, when the product filling the bag is liquid or powder. The reason for the slitting, of course, is to furnish an opening for the bag by means of which each bag is filled at the exit end of the assembly. The purpose of tack sealing the tubing at stated intervals is to retain the sides of the tubing together as it proceeds through the transporting and bagging stages.

As the slit tubing leaves the transport assembly 6 and travels to the exit end of the assembly chassis, the slitter plate 7 remains behind to separate successive portions of the tubular film 1 as they move over the transport 6. Meantime, the slit film 1 is advanced by conventional motor means toward the exit end of the packaging machinery. To that end it is continuously passed through the nip of a co-acting aluminum pressure roll 10 and a rubber or rubber covered drive roller 11.

It should be understood that the drive roller 11 acting in cooperation with the aluminum pressure roller 10 so as to form a nip through which the tubing stock 1 is drawn constitutes the means for moving the product off the tubing roll 1 over the transport assembly 6 and out to the exit end of the entire chassis assembly where the bags are actually filled. As should be appreciated, the drive roller 11 is controlled by a timer, shown schematically at T in FIG. 7, to intermittently move the film a distance coinciding with the desired length of the bag being formed and to be filled. At each interruption of the movement of the film, the slitting operation takes place in the transport assembly and the filling and sealing operations take place at the packaging stage.

Upon emerging from the nip of the pressure and drive rolls 10, 11 the continuous length of slitted tubing passes out of the exit end of the apparatus whereat the tubing is formed into bags, each bag is separately opened at its upper end by means of blower nozzles 40 and filled with whatever is being packaged, by any appropriate means, for example, a gravity flow hopper 17 attached to the bag former/filler housing and suspended over the exit zone of the assembly. As will be appreciated, the bottom of the bag at this point has been sealed during the sealing of the top of the previously filled bag.

If desired, the fill of the plastic tubing bags may be made automatic by mounting the hopper 17 on a shaft fixed to the upper portion of the bag forming and filling housing and actuating the hopper pneumatically, for example, to move down and up into and out of each bag as it is positioned for the fill. Alternatively, of course, the hopper may be secured in a fixed position at or adjacent the mouth of each bag as it is opened for the fill and the material with which each bag is to be filled may be manually poured into the top of the hopper in accordance with the requirements of the occasion.

After being filled, each bag top is sealed off by means of the co-acting rear sealing jaws 36 and front sealing jaws 37 which also seal the bottom of the next bag in line to be filled. The air from the nozzle is cut off completely before and during the sealing process. A drop tray assembly 14 may be provided at a place below the bag fill station so as to receive and hold the supply of filled bags for subsequent shipment or warehousing. The plastic sections between the formed bags is removed by a deflection scrap removal system, including a scrap blow-off which directs the scrap to a deflection plate 15 positioned within the exit end of the bag forming and filling machine, and from which the scrap falls to a scrap collecting area below.

Figure 2:
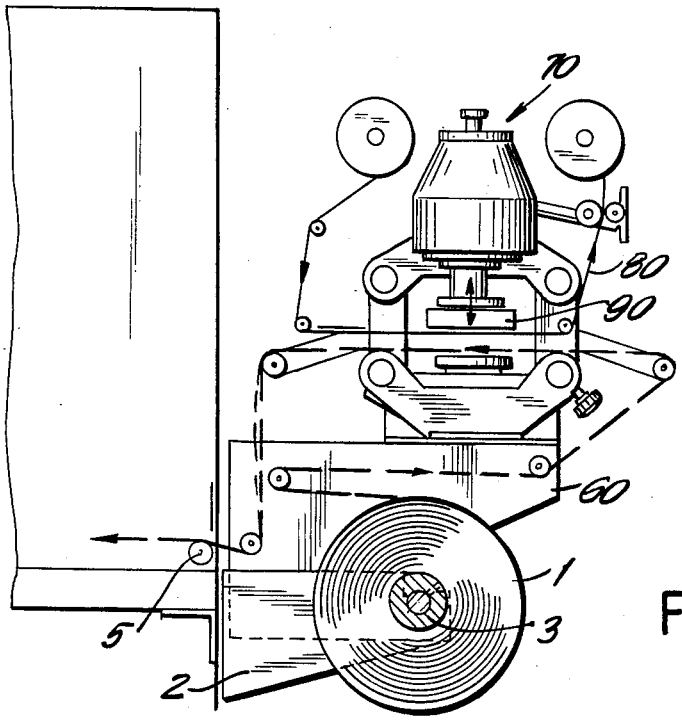
FIG. 2 is a diagramatic flow diagram of optional imprinting apparatus which may be used in conjunction with the apparatus of the invention.

FIG. 2 is illustrative of the optional pre-printing operation wherein the tubular plastic film 1 is run off the roller 3 and through a conventional printer prior to the steps of bag forming and bag filling. As there seen, the printer may be conveniently mounted upstream of the bag forming and filling chassis on an imprinter mounting bracket 60. The unprinted film coming off the rotating product roll 1 is passed through the printing station 70 and there printed with any desired legend or design, or both, by the application of a printing foil 80 or flexigraphic fast dry ink (not shown) at the printer head 90.

Figure 3:
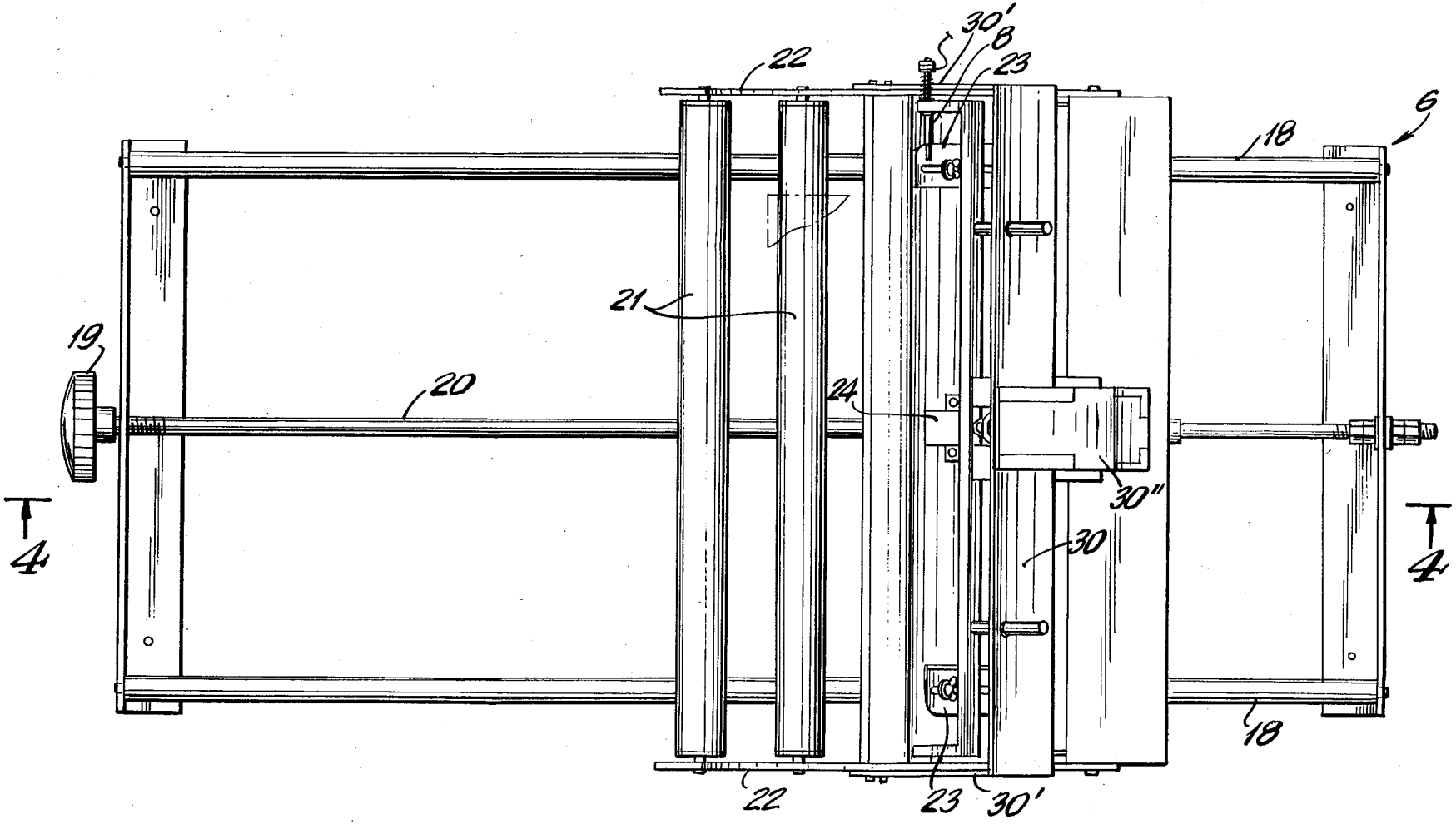
FIG. 3 is a top plan view of the tubular film transport assembly of the apparatus of FIG. 1 showing the film slit and tack sealer.

With reference to FIGS. 3 and 4, the transport unit assembly including the film slitter and spring loaded tack sealer comprises a carriage assembly 6 with spaced tracks 18 over which the transport unit base is adapted to be moved horizontally in either direction for a limited extent of travel as by means of rotation of a position adjustment knob 19 secured to the free outer end of an adjustment rod 20.

Spaced guide rollers 21 mounted for rotation in roller brackets 22 on opposed sides of the transport unit base afford means for travel of the tubular film through the bag forming portion of the overall assembly. Widthwise deviation of the moving film or straying thereof beyond its fixed course is controlled by a pair of co-acting and adjustable film guides 23 disposed on either side of the transport base.

The slitter plate 7 of FIG. 1, only one upper corner of which is apparent in FIG. 3, is manually interposed inside the film tubing at the start of the bag forming cycle, as the moving film travels over the guide rollers 21 and through the film puncturing, slitting, and tack sealing zones. For the step of slitting, a hot slitter wire 8 is mounted in brackets on opposite sides of the transport base so as to span the width of the plastic film. The travel of the slitter wire 8 is obstructed by the slitter plate so that it descends only far enough to contact and effect slitting of the topside of the tubular plastic film running through the machine, thus, leaving the underside of the tubular plastic film untouched and uncut.

Thus, the film passes over the guide rollers 21, the top layer only of the film is slitted across its entire width at appropriately spaced intervals having regard to the requirements of the material with which the bag is to be later filled. At the same time, the top layer of the film may be pin hole punctured above the slit to relieve entrapped air at the packaging stage when the bags are sealed at the exit end of the apparatus. A hole punch is shown diagramatically at P in FIG. 1. The top layer is also tack sealed to the underside of the tubing below the slit as by means of a heated tack sealer 24 reciprocated by air cylinder 30'' which also simultaneously lowers the hot slitting wire into contact with the upperside only of the film and when a puncture in the bottom end of the completed bag is desired, moves the puncture pin (P in FIG. 1) forward as well. The tack sealer seals together both layers centrally of the film at what becomes the leading edge and bottom of the now partially formed bag, and acts to keep the two layers together during travel and assures the bag opening process, retaining the bottom of the bag following the filling operation of the blown open top of the bag being filled.

FIG. 4 is a cross-sectional view along the line 4—4 of FIG. 3 and shows more clearly the position occupied by the slitter plate 7 inside the tubular film 1 as the film travels over the guide rollers 21 including guide roller 25 having Teflon covered wheel 25' mounted in brackets on opposed sides of the horizontally movable transport unit assembly 6. The Teflon tetrafluorethylene covered heat tack sealer 9 is provided with a spring mounted sealing point and is connected to a heating element 26 in contact with a socket base 27 mounted on a support bracket 28. The support bracket member 28 has an extended arm 29 which supports slitter wire 8 between brackets 8' and which is secured at its upper end to a plate 30 mounted via arms 30' secured to roller brackets 22. Plate 30 also supports an air cylinder 30'', the rod of which operates to reciprocate the bracket 28 and thus the hot slitter wire 8 in timed relation to the intermittant drive of drive roller 11. By such means the slitting wire 8 and the tack sealer 9 descend in unison and at predetermined intervals upon the top layer of the plastic film tubing 1 simultaneously to slit the top layer of the film and to tack seal both top and bottom layers of the plastic together, at a point immediately in back of the slitted line of tubing and centrally or medially of its width.

The puncture pin (P in FIG. 1) may be supported from the upperside of the support bracket 28 and also reciprocated by the action of the rod of air cylinder 30''. In unison then the puncture pin P, the hot slitter wire 8 and the tack sealer 9 will descend upon the stationary film as it is passed over the risers 31 of the slitter shown in FIG. 5.

The slitter plate 7 which is shown inside the tubular plastic work piece 1 in FIGS. 3 and 4 is illustrated per se in FIG. 5. That plate may comprise a substantially flat and rectangularly shaped piece of non-magnetic stainless steel sheet stock 32 of approximately 0.035 inch in thickness. The width of the slitter plate 7 may be variable in direct ratio or proportion to the slightly greater width of the plastic tubing 1 within which the slitter plate 7 is placed, as noted in FIGS. 3 and 4. It preferably is rounded out at its four corners 33 so as to reduce or eliminate the possibility of tearing the plastic 1 upon insertion of the slitter plate 7 therein and upon the film being drawn past the slitter plate. To this same end, the bottom of the plate is rounded and thickened relative to the rest of the plate. To accent the space between the top and bottom layers of the tubing 1 during the steps of slitting and tack sealing, the face or upper side of the slitter plate may be provided with a pair of spaced risers 31 between which the puncturing, slitting, and sealing take place. The upper portion 34 or about one-half of the slitter plate 7 is bifurcated or hollowed out medially of its width to allow the tack sealer to effect the seal between the upper and under layers. The raised portion of Teflon covered wheel 25' supports the tubing as the tack sealer impinges upon the upper layer to seal the layers together.

Generally, a pair of spaced co-acting hot wires 41, 42 and heated sealing units 41', 42' at the exit end of the assembly operate at spaced intervals to complete the bag forming assembly. That is to say, the lower of the two wires 42 cuts through the tubing on both sides and the sealer 42, seals it off widthwise so as to close the top of each filled bag while the other and upper wire 41 and sealer 41' cooperate to cut off and seal together the tubing to form the bottom of the next bag to be filled. When the step of sealing takes place, there is a short length of tubing defined by the space between the sealed off top of one bag and the sealed off bottom of the next successive bag. This scrap is blown away by means of air nozzles 40, the blast of which blows the scrap back to deflection plate 15 positioned beneath the run of slit tubing extending between the transport unit assembly and the exit end of the machine. The scrap falls from the plate 15 to a collector, not shown.

Figure 6:
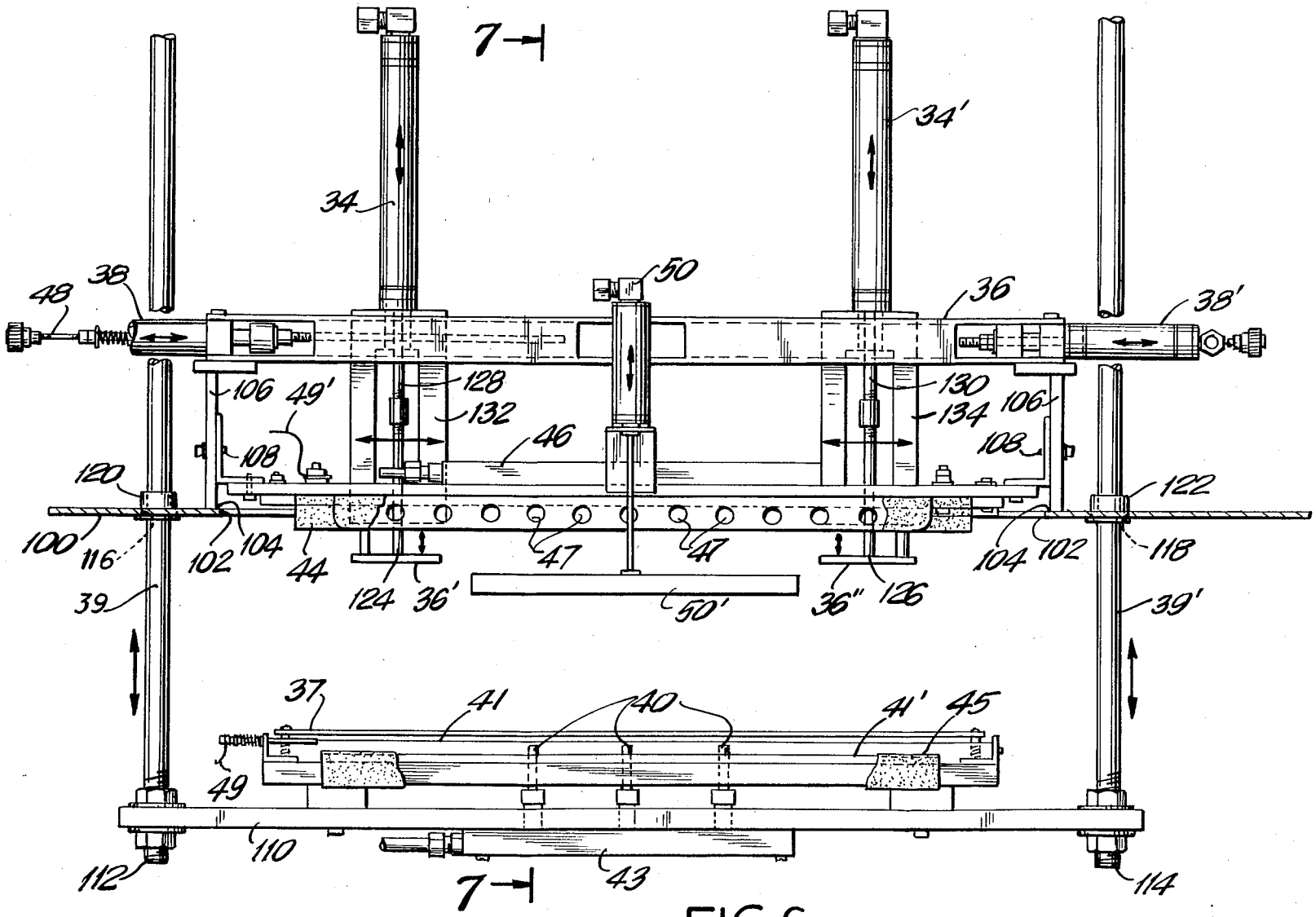
FIG. 6 is a plan view of the bag sealing jaw assembly showing the bag gripping mechanism and scrap blow-off construction at the exit end of the apparatus.
Figure 7:
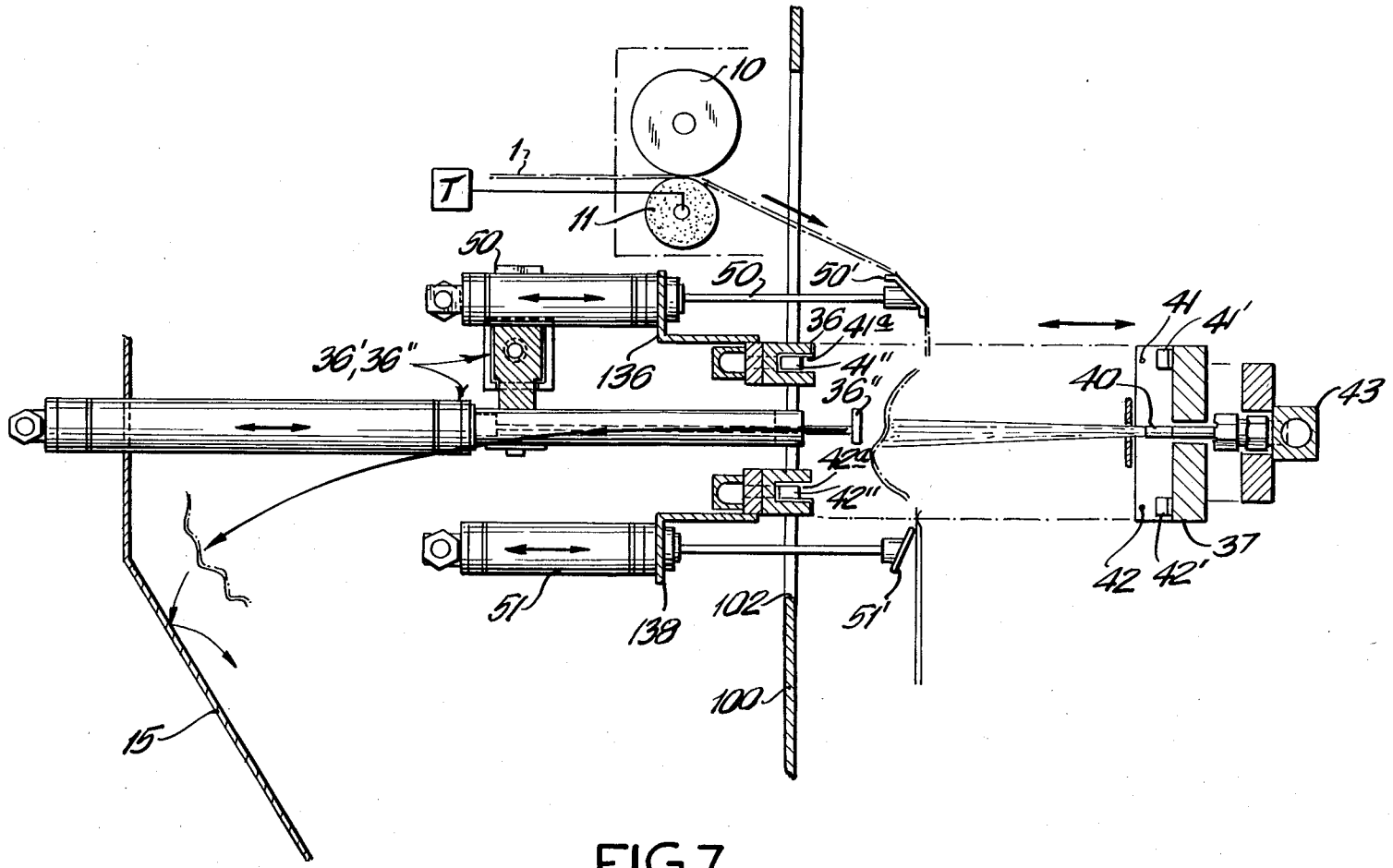
FIG. 7 is a cross-section taken along the line 7—7 of FIG. 6.

The bag forming and bag filling operation follows the steps of slitting and tack sealing. The apparatus and method are seen in FIGS. 6 and 7. More specifically, in the plan view of FIG. 6, a pair of inner air cylinders 34 and 34' control forward and backward reciprocation of the spaced grippers 36' and 36'' which hold the bag at its side edges while it is being filled.

Similarly, a pair of outer air cylinders 38 and 38' are constructed and arranged to control lateral movement of the same bag grippers 36' and 36''. By such means, the sides of the bag are gripped and first held imobile in a fixed, flat position and then they are pushed inwardly toward each other for a relatively short distance, sufficient to facilitate stabilizing the bag at the filling station and assisting in retaining the bag open at the top, initially opened by air nozzles 40. When the filling is complete, the tube sides are then pulled outwardly away from one another to again flatten the tube for lay-flat sealing at the upper and lower edges of the bag.

A pair of air cylinders 50, 51, upper and lower, and mounted centrally of the machine, control reciprocation toward and backward of the upper and lower kicker assemblies 50' and 51'. Thereby the separation of the filled bag from the next bag to be filled is assisted and the removal of the scrap portion of tubing between those two bags by the scrap blow-off nozzles 40 is supplemented.

Reciprocation of the front jaw sealing assembly 37 toward and away from the rear jaw sealing assembly 36 (which does not reciprocate) is controlled by means of the conventionally actuated push-pull rods 39 and 39' on either side of the machine frame. These rods 39 and 39' may be actuated to move in unison and to the same degree by conventional means such as another pair of air cylinders or by a gearing connected to the drive roller member 11 with which, in any event, the front jaw assembly must be timed. When the front jaw assembly 37 is moved into contact with the rear jaw assembly 36, the hot wires 41 and 42 simultaneously cut through the top of the bag already filled and the bottom of the next bag to be filled; and the top and bottom heated jaws 41' and 42' of front sealing jaw 37 close against corresponding upper and lower heated jaws 41'', 42'' of the rear jaw assembly 36 and seal off the severed top of the filled bag and the bottom of the next bag to be filled. To this end, hot wires 41 and 42 are positioned to enter the spaces $41^a$ and $42^a$ formed in the upper and lower jaws 41'', 42'' of rear jaw assembly 36 to permit bag sealing contact between the cooperating front and rear jaws.

Thereafter, the front and rear sealing jaws separate by movement of the front sealing jaws away from the rear sealing jaws. The upper and lower kicker assemblies 50 and 51 move forward and the blowers 40 propel the tubing scrap, between the top of the filled bag and the bottom of the next bag to be filled, in the direction of the scrap deflector plate 15.

Air is supplied to the air nozzles 40 through the blow-off air manifold 43. The heated sealing jaw assemblies 36, 37 are covered with Teflon plastic as at 44, 45, respectively, to assure the plastic tubing will not stick to the jaws. Additionally, an air manifold 46 is connected to the rear jaw assemblies 36 so as to cool those assemblies during the operation thereof. This cooling action may be aided by providing a plurality of air escape vents or holes 47 widthwise of the rear jaw assemblies.

To accommodate the filling of bags of different widths, means may be provided on one side of the machine frame in the form of a conventional width adjustment device 48 for the bag grippers 36' and 36''.

The front and rear jaw sealing assemblies 37, 36 may be heated as by means of the coacting electrical connections 49, 49', respectively.

FIG. 6 illustrates support elements for the parts in the bag filling stage. These elements may comprise a front panel 100 having a cut-out portion intermediate of its sides 102, from the inner ends 104 of which a pair of spaced side bars 106 project rearwardly. The rear jaw assembly 36 is fixedly mounted on the side bars 106 as by conventional fastening means 108.

The front jaw assembly 37 is mounted for reciprocation on the push-pull control rods 39, 39' on either side of the open portion of the front frame 100 as by means of the support bar 110 secured to the free ends 112, 114 of the rods 39, 39'. The panel 100 is also apertured as at 116, 118 and provided there with collars 120, 122 to slidably engage the reciprocable rods 39, 39'.

Bag grippers 36' and 36" are secured to the forward ends 124, 126 of the push-pull rods 128, 130 which slidably engage the yokes 132, 134, respectively. Lateral movement of the same grippers 36' and 36" is afforded by means of bodily movement of the yokes 132 and 134 relative to each other.

Kicker assemblies 50' and 51' may be slidably attached to the air cylinders 50, 51, respectively, which cylinders in turn are secured to the rear sealing jaw assemblies as by bracket members 136, 138.

In operation, the slitted tubing 1 to be formed into bags passes through the nip of the rollers 10, 11 and between the upper set of jaws of the front and rear sealing jaw assemblies 37 and 36. At that time, the sealing jaws are in the open or expanded position, and the top and bottom kicker assemblies 50, 51 are retracted. At that point, forward movement of the tubing is interrupted. The front sealing jaws 37 retract to contact the rear sealing jaws 36; and the lower edge of the upper bag (to be filled) is cut by the hot wire 41 and sealed off by action of the heated upper jaw. At the same time, the top edge of the lower bag (filled) is similarly cut by wire 42 and sealed off by action of the heated lower jaw.

The scrap portion of tubing defined by the space between the top edge of the filled bag and the bottom edge of the unfilled bag is then blown away by the air blow-off nozzles 40 fed from the air blow-off manifold 43.

The upper unfilled bag is moved down via rollers 10, 11 into bag filling position where it is gripped at its sides by the spaced side grippers 36' and 36" which are moved into that gripping position by the inner cylinders 34, 34'. The grippers then move inwardly in a direction toward each other a relatively short distance as by means of the outer air cylinders 38, 38'. At the same time, the bag is blown open and filled.

Thereafter the side grippers 36', 36" reverse their previous action by moving laterally and away from each other and then opening up longitudinally to release the filled bag. At the same time, the upper and lower kicker assemblies 50' and 51' move out to a point forward of the rear sealing jaws 36 and rearward of the front sealing jaws 37.

The cycle of bag forming and filling thus described is then repeated until all of the material that is to be bagged is placed inside the bags, and the filled bags are removed from the packaging apparatus for warehousing or transportation elsewhere.

What is claimed is:

1. In a method of continuously forming and filling plastic film bags which comprises the steps of successively providing a continuous length of tubular plastic film of pre-selected width, transversely slitting only the topside of the film at pre-determined intervals lengthwise of the film, moving the slitted film into a bag forming and filling station, forming the plastic film successively into a plurality of open top bags, filling each bag with the desired material through the opening formed by the slitting step, the improvement comprising substantially simultaneously performing all of the following steps at the same location in the bag forming and filling station before it is moved from the station; the steps of sealing off the top of each filled bag, sealing off the bottom of the next bag to be filled, cutting away the material between the seals, removing the cut away material before advancing the film for the next filling step while removing the previously filled and sealed bag from the bag forming and filling station.

2. The method of claim 1 which includes a further improvement comprising the step of tack sealing together the top and bottom layers of the film simultaneously with the step of slitting the top side of the film at predetermined intervals.

3. The method of claim 1 which includes a further improvement comprising the steps of perforating the top side surface of the film simultaneously with the step of tack sealing together the top and bottom layers of the film and the step of slitting the top side of the film at predetermined intervals.

4. Automatic continuous bag former and filler apparatus comprising:

a. means for unwinding a continuous length of tubular plastic film forwardly from a supply roll;

b. means for moving the unwound film through said apparatus and initially through a film slitting zone;

c. barrier means interposed inside the moving film during its passage through the slitting zone to separate and maintain the top and bottom layers of the film out of contact with each other;

d. slitting means interposed medially of the barrier means for substantially simultaneously slitting widthwise only the top of the film in predetermined spaced intervals;

e. said moving means being operative for then moving said tubular film from the slitting zone to a bag forming and bag filling station;

f. means disposing predetermined lengths of said film, one at a time, in said bag forming and filling station in a vertical plane with the top slitted side facing forwardly and the slit disposed uppermost of each predetermined length of said film;

g. means for holding each said predetermined length in said station in a fixed position in said vertical plane;

h. means for opening each slit in the top side of each predetermined length of said tubular film formed as a bag with a sealed bottom and holding it open in the fixed position;

i. means for filling the bag while the bag is being held in the fixed position;

j. means in said bag forming and filling station above and below the slit of the predetermined length of said film just disposed in said bag forming and filling station for simultaneously sealing the tubular film above and below each slit to form by sealing the bottom of the bag next to be formed and filled and the top of the just formed and filled bag respectively, in advance of the disposition of the next predetermined length of said tubular film the bottom of which is sealed by said sealing means, but which has yet to be filled;

k. means in said bag forming and filling station mounted in horizontal alignment with said means for simultaneously sealing the tubular film above and below each slit for cutting the length of the tubular film above and below each slit between the seals formed by said sealing means after the bag has been filled;

l. means in said bag forming and filling station mounted between said sealing means and between said cutting means for removing the length of film which has been cut by said cutting means;

m. means for releasing the filled bag and permitting its removal from the bag forming and filling apparatus; and n. said moving means also comprising means for timing said disposing means, said sealing means, said cutting means, said removing means and said releasing means for continuously forming, filling and releasing each next predetermined length of said tubular film.

5. The apparatus of claim 4, wherein the said barrier means comprises a substantially flat plate with riser means for raising the top layer of said tubular film.

6. The apparatus of claim 5, wherein said riser means comprises a pair of risers longitudinally spaced with respect to the axis of travel of said tubular film and means are provided for mounting said slitting means for slitting the top of the film between said pair of risers.

7. The apparatus of claim 5, wherein a space is provided through said barrier plate along the path of travel of the film and means are mounted in said slitting zone for tack sealing the top and bottom layers of the film within the space in said barrier plate at predetermined intervals intermediate the sides of the film and forwardly of each slit before the film is moved to the bag forming and bag filling station.

8. The apparatus of claim 4, wherein said means for holding the predetermined length of said tubular film in a fixed position while it is being filled comprises gripper elements mounted in said bag forming and filling station disposed on either side of the bag.

9. The apparatus of claim 8, wherein said means for opening each slit in the top side of each predetermined length of said tubular film and holding it open in a fixed position comprise a pair of spaced grippers constructed and arranged to grasp the slitted bag at its sides, means for moving the grippers toward each other a distance sufficient to permit opening of the top of the slitted bag, and means in front of the bag to open the top of the bag and enable the bag to be filled.

10. The apparatus of claim 9, wherein said means for moving said grippers also comprise means for moving the same away from each other and for releasing the sides of the bag.

11. The apparatus of claim 9, further characterized in that the means for opening the slitted top of the bag and enabling the bag to be filled comprises at least one air nozzle.

12. The apparatus of claim 4, wherein said means for removing the length of film which has been cut by said cutting means includes means for blowing the film cut from between the sealed top and bottom of successive bags in a direction transverse to a direction of movement of the tubular film and a scrap blow-off deflection plate within said apparatus and below the path of travel of said tubular film.

13. The apparatus of claim 4, wherein said means for releasing the filled bag and permitting its removal comprises an air cylinder actuated reciprocating kicker assembly.

14. The apparatus of claim 4, including means mounted in the film slitting zone for centrally perforating the top side surface of the film at predetermined intervals to provide air exhaust for the bag at the bag filling and sealing stage.

15. In a machine for continuously forming and filling bags from a supply of flat plastic film tubing which is moved forwardly through the machine, barrier means constructed and arranged to separate and maintain the top and bottom layers of the plastic film tubing out of contact with each other as the tubing is moved to and past said barrier means, said barrier means comprising: a substantially flat plate of a width proportional to the width of the plastic film tubing within which the plate is adapted to be placed, the face of said plate in contact with the top layer of the tubing being provided with a pair of risers longitudinally spaced with respect to the axis of travel of the tubular film and constituting means between which successive lengths of the top layer of the plastic film tubing are positioned for transverse slitting.

16. The barrier means of claim 15 further characterized in that a space through a portion of said plate is provided along the path of travel of the film and constituting means through which successive lengths of upper and under layers of the film are joined and tack sealed together.

* * * * *